United States Patent [19]

Sullivan

[11] 4,341,198

[45] Jul. 27, 1982

[54] WOOD BURNING STOVE

[76] Inventor: Paul D. Sullivan, 15 Juniper La., Medfield, Mass. 02052

[21] Appl. No.: 205,345

[22] Filed: Nov. 10, 1980

Related U.S. Application Data

[63] Continuation-in-part of Ser. No. 4,702, Jan. 19, 1979, abandoned.

[51] Int. Cl.[3] ..... F24B 7/00

[52] U.S. Cl. ..... 126/68; 126/77; 126/66

[58] Field of Search ..... 126/58–68, 126/77, 83

[56] References Cited

U.S. PATENT DOCUMENTS

| | | | |
|---|---|---|---|
| 2,352,567 | 6/1944 | Raulston | 126/77 |
| 4,192,286 | 3/1980 | Wormington | 126/121 |
| 4,201,186 | 5/1980 | Paquin | 126/63 |

FOREIGN PATENT DOCUMENTS

| | | | |
|---|---|---|---|
| 490194 | 8/1938 | United Kingdom | 126/58 |

*Primary Examiner*—James C. Yeung
*Attorney, Agent, or Firm*—Dahlen & Gatewood

[57] ABSTRACT

A wood burning stove is disclosed which includes a stove housing that defines an upper zone comprising storage and exhaust chambers, and a lower zone for accommodating a wood burning fire. The exhaust and storage chambers are separated by a divider, both chambers having bottom openings that communicate directly with the top of the lower fire zone. Covering one opening in the housing and providing access to the fire zone is a fire door while another opening provides access at the top of the storage chamber and is covered by a wood fill door. The exhaust chamber communicates with and discharges smoke into a stovepipe or flue retaining chimney. A supply of logs is loaded into the storage chamber through its fill door. These feed automatically and sequentially by gravity from the storage chamber bottom into the fire zone for consumption by a fire burning therein. The frequency of wood loading operations is reduced in that a suitable supply of logs for burning and maintaining a continuous fire over a long period of time is provided in one loading operation.

32 Claims, 8 Drawing Figures

WOOD BURNING STOVE

CROSS-REFERENCE TO RELATED APPLICATION

This patent application is a continuation-in-part of my earlier filed application, Ser. No. 004,702, filed Jan. 19, 1979, for "Wood Burning Stove", abandoned.

BACKGROUND OF THE INVENTION

1. Field of the Invention

This invention relates in general to a stove for burning wood logs and, more particularly, to a highly efficient wood burning stove having a log storage chamber from which logs are fed automatically by gravity into a burning fire, as logs fed earlier are consumed by the fire, resulting in a wood burning fire over a longer period of time with little or no needed attention.

2. Description of the Prior Art

Until recent years many, if not most, modern heating systems have relied on petroleum products, in particular fuel oil, as a primary source of energy. However, the steady increase in the cost of fuel oil in the more recent years, accentuated by the growing rate of inflation, has created increased interest in alternate fuel sources. One source of heat that is experiencing revived interest and presently has substantial popularity is the wood burning stove which capitalizes on, and makes use of, the nation's abundant wood supply. Although many innovations have been introduced in wood burning stoves over those used in years past, certain troublesome disadvantages still continue to exist. One such disadvantage results from the fact that all wood burning stoves of which I am aware, and which have existed prior to my invention, must be manually stoked at relatively frequent intervals, to ensure a continuous fire and the resultant desired heat output. Also, despite various improvements in burning efficiency, a substantial portion of the inherent energy present in wood consumed by present wood stoves is lost in the form of combustion products that are discharged through chimneys.

Accordingly, a major object of this invention is to provide not only more efficient wood burning stoves but one in which the necessary frequency of manual stoking is reduced.

SUMMARY OF THE INVENTION

The invention is a stove for burning wood which includes a stove housing that defines in its basic aspects an upper zone defining a fuel storage chamber and an exhaust chamber separated one from the other, and a lower zone for accommodating a wood burning fire. The storage and exhaust chambers each have bottom openings that communicate directly with the top portion of the lower fire zone.

The housing is provided with an opening covered by a wood fill door which provides access to the top of the wood storage chamber for loading the chamber with a supply of logs. Covering an opening in the housing in the lower zone is a fire door which provides access directly to the lower fire zone for removal of ashes. The top of the exhaust chamber communicates through an opening in the housing with a flue or stove pipe for draft and discharge of smoke.

In the most preferred aspect of the stove of the invention, the wood storage chamber is defined by a vertically disposed back wall and becomes increasingly larger in depth from top to bottom resulting in less chance of the log supply jamming and a more free flowing fuel supply as needed. Enhancing this in the more preferred aspect of the invention, is an inclined surface connecting the back wall to the bottom which acts to cause the bottom logs in the fuel supply to be pushed forwardly in the lower fire zone. Means are provided adjacent to the wood fill door for aid in loading and maintaining the logs horizontally disposed and oriented somewhat parallel to one another in the storage chamber, for further preventing log jams occurring.

Air intake means are provided in the lower zone which provides the only air supply for the burning fire. In the preferred embodiment of the invention, air is supplied through a manifold which supplies air across the front of the stove and from underneath and to the entire width of the burning logs.

In another embodiment of the invention, the stove includes a heat transfer chamber at least adjacent to the bottom of the housing; however, in some cases a heat transfer chamber will be advantageously provided along the back wall as well. Thus, not only can forced heated air be provided by the stove of the invention as well, creating a more efficient stove, but such heat transfer chamber serves to provide the stove housing with a cooler back wall and bottom surfaces. Cooler outer surfaces allow positioning of the stove closer to the walls and floor of a room without need for providing added insulation in the stove housing, or on the rooms floor and wall where the stove is located.

In operation, the storage chamber is filled through the fill door with a supply of suitable length logs. The logs in the fire zone on the grating are lighted and the fire started. As logs are consumed in the fire zone other logs feed from the storage chamber by gravity automatically into the fire burning zone and are in turn lighted, providing quite advantageously a relatively continuous slow and long burning fire. The storage chamber is re-loaded with logs as needed but much less frequently than in the case of wood burning stoves having only a fire zone, and not both a fuel storage chamber and fire burning zone.

BRIEF DESCRIPTION OF THE DRAWINGS

The above and other objects and features of the present invention will become more apparent upon reading of the following description taken in conjunction with the accompanying drawings wherein.

DETAILED DESCRIPTION OF THE INVENTION AND THE PREFERRED EMBODIMEMTS

Figure 1:
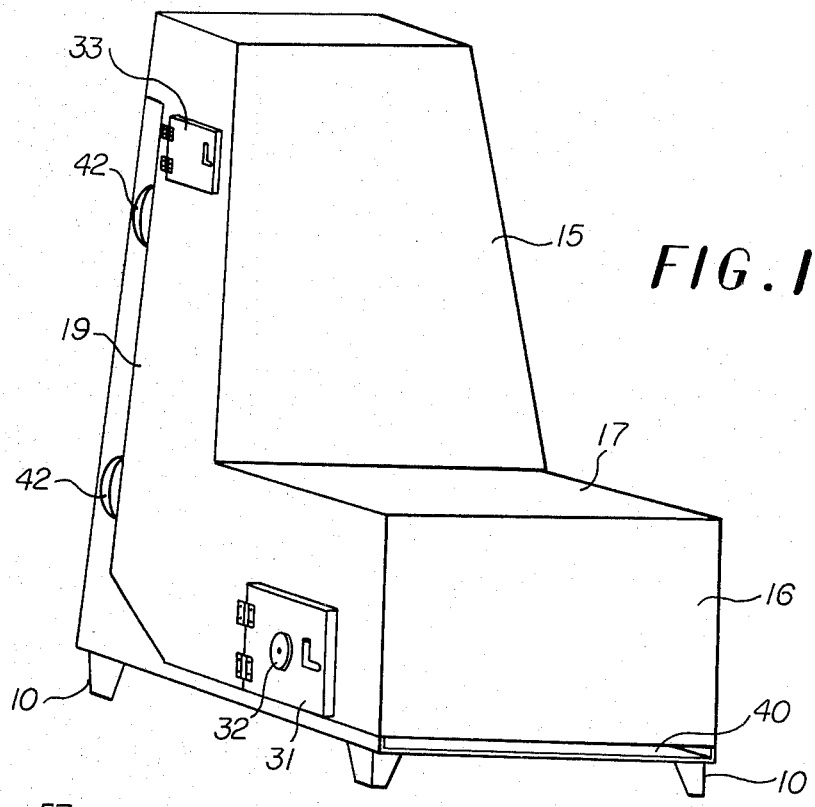
FIG. 1 is a schematic view in perspective of one embodiment of a stove constructed in accordance with the present invention.
Figure 2:
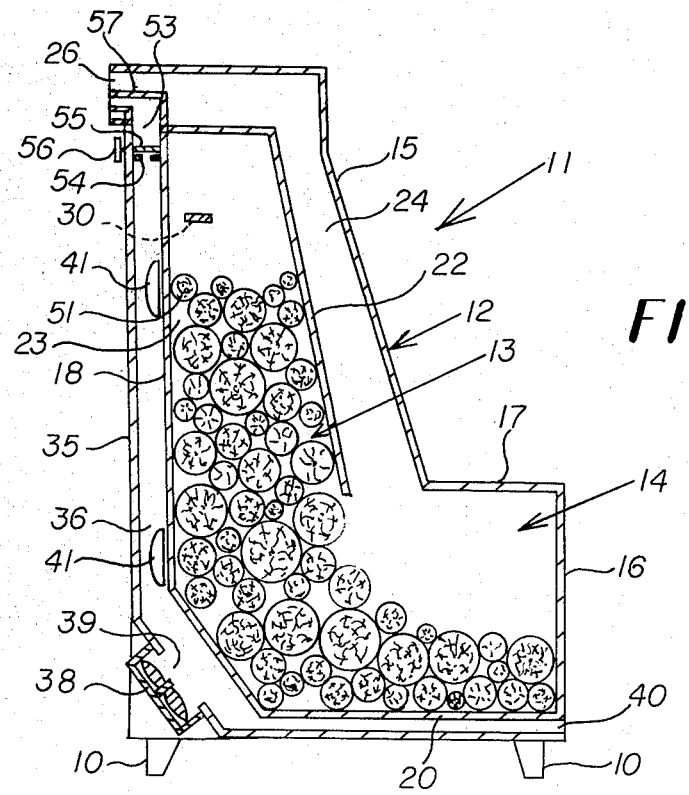
FIG. 2 is a cross-sectional view taken along secant line 2—2 of FIG. 3.
Figure 3:
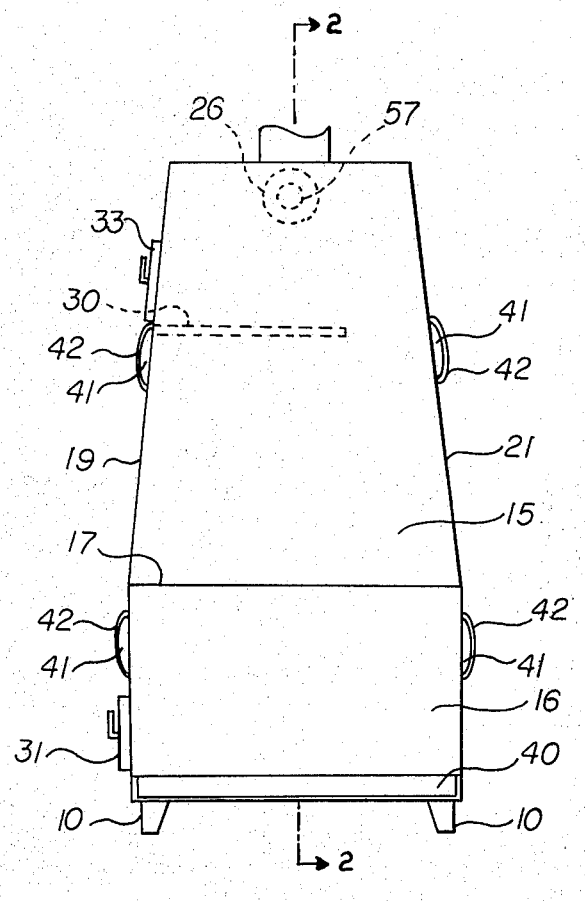
FIG. 3 is a front view of the stove shown in FIG. 1.

Referring now to FIGS. 1–3, there is shown therein a wood burning stove 11 constructed in accordance with the present invention which is defined by a housing 12 supported by legs 10. Included within housing 12 is an upper zone 13 and a lower zone 14, the latter being suitable for accommodating a wood burning fire as hereinafter more fully described. Housing 12, as shown, comprises a planar upper front wall portion 15 which inclines rearwardly and a planar lower vertically disposed front wall portion 16 that straddle a planar horizontally disposed front wall portion 17 positioned above and defining the upper portion of fire zone 14 and disposed to accommodate utensils for cooking. Housing 12 further comprises a horizontally disposed bottom or floor portion 20, a vertically disposed back wall portion 18, and side walls 19 and 21 that extend between the front wall portion and rear wall.

Located within housing 12, as seen more clearly in FIG. 2, is a divider 22 that extends between and is connected with the side wall portions 19 and 21 and which divides upper zone 13 into a wood storage and feed chamber 23 and an exhaust chamber 24. Both the storage chamber 23 and the exhaust chamber 24 are open at their bottoms, with the top of communicating fire zone 14. As will be appreciated, divider 22 prevents gases flowing between storage chamber 23 and exhaust chamber 24 these chambers communicating only with fire zone 14 and not with one another. A smoke discharge opening 26 communicates with the upper portion of exhaust chamber 24 and is adapted for connection with a suitable conventional flue assembly (not shown).

Mounted on the side wall 19 is an air tight fire door 31 covering one opening in the housing 12 and providing access to the fire zone 14. An adjustable air intake vent 32 is located in the center portion of air tight fire door 31 by means of which air can be provided to the fire zone for supporting combustion. Another opening in the side wall 19 is covered by an air tight fill door 33 that provides access to the upper portion of wood storage chamber 23. A guide bar 30, the purpose for which will later be made clear is attached to the side wall 19 adjacent to the fill door 33 and extends perpendicularly from wall 19 into the storage chamber 23.

Secured to housing 12 is a skirt 35 that defines a heat transfer chamber 36 juxtaposed to the back wall 18 and bottom surface 20. A fan 38 is mounted on the skirt 35 aligned with an air intake opening 39 therein. When energized, fan 38 pulls air in from the surrounding environment and forces it through the intake opening 39 into the heat transfer chamber 36 wherein the air is heated and discharged from front discharge opening 40 located adjacent to the front wall portion 16 and lateral discharge openings 41 located on both sides of the housing 12. As shown in FIGS. 1 and 3, lateral discharge openings 41 are covered with hoods 42 that deflect air discharging through the openings 41 toward the front portion of the stove and out into the room being heated.

In preparing to use stove 11, the storage zone 23 is filled with a supply of logs 51 as illustrated in FIG. 2. The logs 51 are loaded into the storage chamber 23 through the fill door 33. During the loading operation, each log is supported by guide bar 30 before dropping. Thus, the logs are oriented initially horizontally and on dropping into the chamber tend to maintain their initial orientation resulting in the logs being stored as shown in FIG. 2, in parallel relationship.

Once storage chamber 23 has been stoked with logs 51, the fire door 31 is opened and suitable kindling material is inserted for initiating the fire. As storage chamber 23 is air tight, once fill door 33 is closed burning occurs in fire zone 14 and continues only by air being admitted through air intake vent 32, as needed. The gaseous products of combustion, as will be appreciated, exhaust through exhaust chamber 24 open to the atmosphere. The wood logs burning in the fire zone 14 are consumed by combustion, leaving a void for logs from the storage chamber 23, to automatically and sequentially be fed by gravity, providing a relatively continuous source of fuel. Because of this arrangement, restoking of stove 11 is required only occasionally after an extended period of burning.

When energized, fan 38 pulls air from the surrounding environment into the heat exchange chamber 36 and forces it out through discharge openings 40 and 41. The relatively cool incoming air is heated by contact with the hot surfaces of the back wall 18 and bottom wall 20 before being discharged through the discharge openings. The heat exchange that occurs within chamber 36 and the providing of heated air as well as convection heat greatly increases the efficiency of stove 11. In addition, heat transfer chamber 36 serves to thermally isolate the extremely hot rear and bottom surfaces of stove housing 12 thereby reducing the minimum spacing required between the stove 11 and the walls of a surrounding structure and possibly the need for insulation.

The operation of the stove 11 is further enhanced also by the air control system illustrated in FIGS. 2 and 3. As shown in those figures an opening 53 in the housing 12 provides for air flow between the top portion of the exhaust chamber 24 and the heat exchange chamber 36. Air flow through the opening 53 is controlled by a conventional slide valve 55 supported on a valve seat, in which is provided opening 54. An operating knob 56 is used to adjust slide valve 55 and to discharge more or less air from the heat transfer chamber. Connected to the opening 53 is an open ended circular-shaped pipe 57 centrally located within flue opening 26 that directs air from the heat exchange chamber 36 into the flue (not shown). Thus, during adverse environmental conditions, the draft of the stove 11 can be greatly improved by opening the valve 55 to produce movement of hot air from the heat exchange chamber 36 into the exhaust zone adjacent to the flue opening 26.

As shown in FIGS. 1 and 3, the width of the storage chamber 23 increases continuously between its top and bottom portions. Similarly, as shown in FIG. 2, the depth of the storage chamber 23, i.e., front to back, also increases continuously between its top and bottom portions. These features help insure a continuous, uninterrupted supply of logs from the storage chamber 23 into the fire zone 14. Because of the increasing dimensions of the log storage chamber, particularly in the depth direction, the possibility that logs will become jammed against the walls of the storage chamber 23 is substantially reduced.

Figure 4:
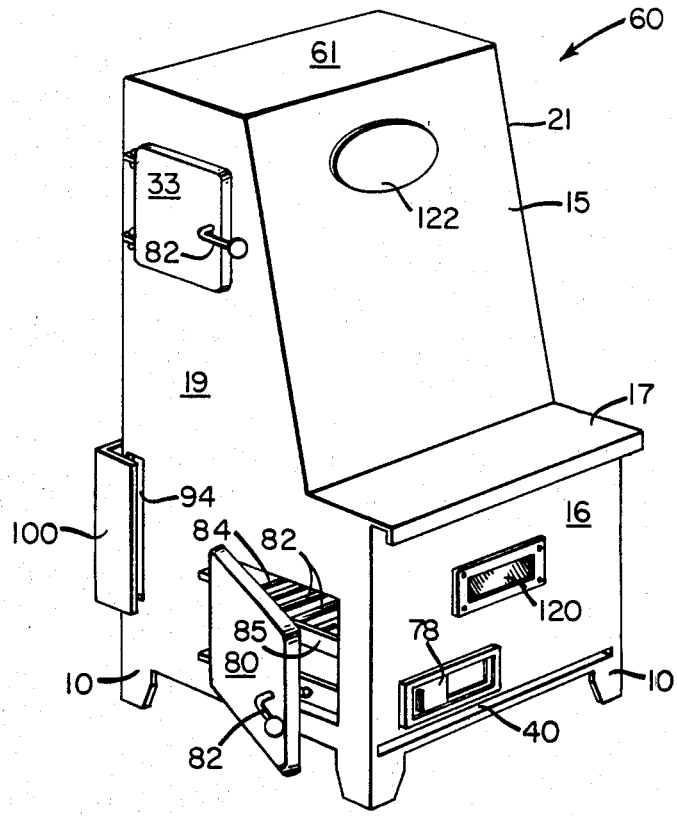
FIG. 4 is a schematic view in perspective of another embodiment of a stove of my invention.

Turning now to FIG. 4 of the drawing, there is shown therein a further and somewhat modified embodiment of a stove 60 in accordance with my invention. Stove 60, as in the case of stove 11 earlier disclosed, has, most importantly, an inclined front wall portion 15 and internally defined upper zone 13 and lower zone 14. Upper zone 13 is separated into wood storage chamber 23 and exhaust chamber 24 by divider 22 which contrary to that configuration shown in FIG. 2 is parallel to and located closely adjacent to inclined front wall portion 15. Either construction shown, however, will be found satisfactory, the main consideration being that a sufficient opening be provided by exhaust chamber 24 that combustion gases will be fully discharged from fire zone 14. In connection with this, in general, an exhaust chamber having an opening of about the same cross-sectional considerations as the flue opening will be found satisfactory in operation. The lesser the depth of the exhaust chamber, the greater, in general, can be the depth of the wood storage chamber, resulting in not only somewhat greater storage capacity but somewhat better log feeding characteristics.

Figure 5:
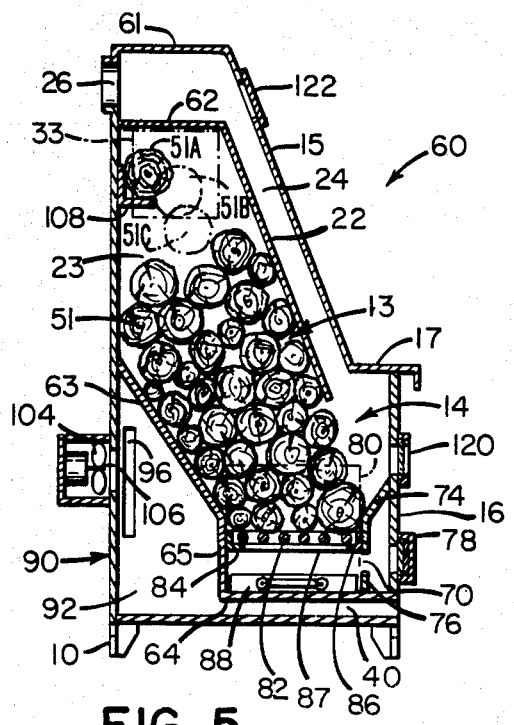
FIG. 5 is a side view of the stove shown in FIG. 4 with the wall removed on the fill side so as to better visualize the stove's upper and lower zones and the bottom heat transfer chamber.
Figure 6:
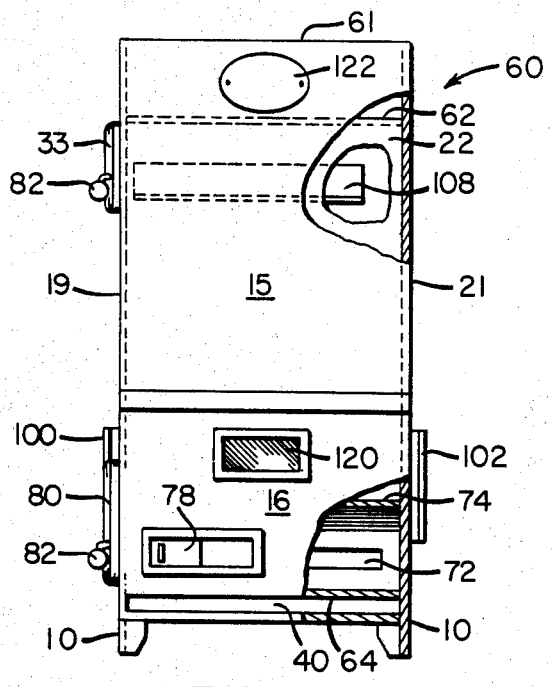
FIG. 6 is a view of the front of the stove shown in FIG. 5.
Figure 7:
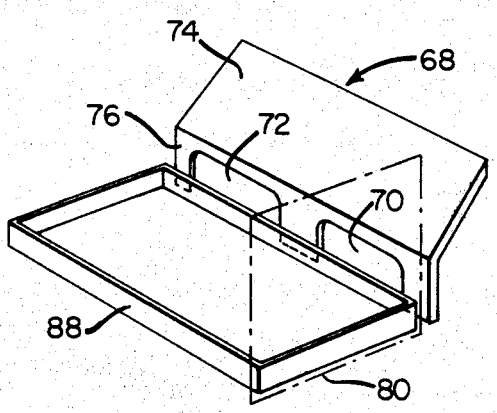
FIG. 7 is a perspective view which better shows the relationship of the ash pan and the air manifold in the stove of FIG. 4 with the fire door.

As shown more clearly in FIG. 5, exhaust chamber 24 will be somewhat larger in cross-section at its discharge end, being defined by horizontally disposed, spaced-apart, planar top housing surface 61 and top divider surface 62. Thus, the stove housing can more readily accommodate an opening the size of smoke discharge opening 26 for connection with conventional stovepipe and the usual flue opening in a chimney.

The inclination of front-wall portion 15 can, of course vary somewhat; however, most desirably this surface will incline at an angle from 60–75 degress from the horizontal. The less the angle of inclination, the less wood can be stored in storage chamber 23, for any particular size stove. The greater the angle of inclination, the less surface there will be for convection heating. And, most importantly, the less residence time there will be for heat transfer to wall portion 15 from the combustion gases passing through exhaust chamber 24.

The bottom surface of the stove housing, i.e., the floor of lower fire zone 14 is defined by planar inclined surface 63 and horizontally disposed planar bottom surface 64, connected together by vertically disposed planar surface 65. These surfaces extend the width of the housing and as will be appreciated, are joined at their respective ends to side walls 19, 21. As will be readily apparent from reference to FIG. 5, surface 63 in its preferred inclined disposition, as shown, functions to not only support the logs feeding into the lower zone 14 from storage chamber 23, it acts also to cause those lower logs supported to be moved forwardly into the fire zone for burning as the more forward located logs are consummed by fire. The angle of incline, as will be appreciated, can vary somewhat so long as surface 63 is inclined sufficiently to accomplish the intended dual function. Obviously, the flatter the incline, the more it will support the logs, and the less it will cause the logs to move forward. In general, however, an angle of about 45°–70° from the horizontal will be found most satisfactory. Although surface 63 can, in some instances be flat, it will be appreciated that this is less preferred.

To better supply air to the burning logs, stove 60 is provided with an air manifold 68 having discharge ports 70, 72. As shown in the drawing (FIG. 5) air manifold 68 is defined by inclined planar top surface 74 connected to vertically disposed planar rear wall 76 in which at the bottom thereof the discharge ports 70, 72 are located. Top surface 74 and rear wall 76, as shown, are integral with or otherwise joined to front wall portion 16 of the stove housing and bottom surface 64. Thus, air is supplied to fire zone 14 via air manifold 68 through conventional slide valve 78 located in the front surface 16. As the manifold extends laterally the width of the housing, air is supplied simultaneously to the entire width of the burning logs, rather than from just the fire door end thereof, as in the case of the stove of FIGS. 1–3. Fire door 80, accordingly, like fire door 33, is a solid, air tight, door, which may be opened and closed by a conventional handle 82. Although manifold 68 is shown to have two discharge ports, it will be appreciated that such is not critical. More discharge ports can be provided, if desired. These can be of various sizes and configurations, for example, a series of ¾ inch diameter circular-shaped holes or openings in wall 76. The main consideration being that the manifold provides air to substantially the entire width of the burning log fire.

As will be seen by reference to FIG. 5 vertical walls 65, 76 and floor 64 define an elongated, rectangular-shaped open-topped well in which is located a conventional grating or grille 82. The grating is supported at its longitudinal sides by angle arm support members 84, 86 secured to respective walls 65, 76 by suitable mechanical fastening means, or by welding or the like. These support members are desirably located so that grating 82 is located within the well and logs 51, as shown in FIG. 5, are contained. The logs are, in part, contained by the V-shape formed by inclined surface 63 and top surface 74, the latter which may suitably be inclined at the same angle from the horizontal as inclined surface 63. The well, most desirably, will be located nearer front wall portion 16 rather than further away therefrom, so that heat from the burning logs will be projected to the front of the stove, providing more efficient heating of the room in which the stove is located.

In the well, below grating 82 is located rectangular-shaped ash pan 88 for the collection of ashes formed as the burning logs supported by the grating are consumed. Ash pan 88 is slidable in and out of the well, as desired, on opening fire door 80. Ash pan 88 can be provided with a handle to aid its removal; however, in any event caution must be exercised as the pan will generally be quite hot. Instead of grating 82 being supported as indicated in FIG. 5, angle iron support members can be disposed at the opposite ends of the grating e.g., as indicated by reference numeral 85 (FIG. 4). Thus, the vertically disposed member of angle iron 85 will act to prevent ashes from spilling out when fire door 80 is opened. This member desirably will be sufficiently wide enough to accomplish this purpose and need not be of the same width as the horizontally disposed support member of the angle arm support. The ends of angle iron support 85 can be welded or otherwise secured to walls 65, 76. Although not shown in the drawing, it will be appreciated that a further angle iron is located at the other end of the well, to support the opposite end of grating 82.

The bottom of the stove housing is provided with a skirt 90 which in combination with the bottom stove surface defines a heat exchange chamber 92 having a front discharge opening 40, as before described, and side wall openings 94, 96. Openings 94, 96 are covered with deflectors 100, 102 which deflect heated air toward the front of the stove and outwardly into the room, being heated. Cooler room air, as will be appreciated, is forced into heat exchange chamber 92 by means of caged fan 104 through opening 106 located in the back wall of the skirt.

To assist in loading storage chamber 23, log slider or guide 108 is critically provided adjacent fill door 33.

Log slider 108 comprises a conventional 90° angle iron one leg of which can be, if desired, wider than the other. In any event, the horizontally disposed leg of the angle iron should be of sufficient width to accommodate the largest diameter log to be burned. The log slider extends substantially the width of the stove and is secured to the back wall in horizontally disposed fashion.

In use, fill door 33 is opened and storage chamber 23 is filled with logs of suitable diameter and length. The logs, in general, can be of various sizes depending somewhat upon the size of the stove involved and the ability to handle the logs. Logs which are of the same length will be found most suitable and of a length substantially the width of the storage chamber less 1–2 inches. Using such similar length, longer logs provides less tendency for log jams to occur.

When a log 51 is inserted into the fill door opening, the log should be slided into the storage chamber on log slider 108. Thus, the log will be supported horizontally in the storage chamber and when released will fall, as indicated in FIG. 5, by logs 51A, 51B, 51C (shown in phantom) rather than end first. The chamber need not be filled completely at any one time unless this is desired. However, during the cold, winter months, the log storage chamber can most desirably be completely filled, providing fuel for a rather, long continuous fire without need for repeated stoking. The fuel supply, depending somewhat on the size of the stove, will last for 24 hours or so, making it unnecessary, for example, to wake up during the night to stoke the fire, or failing to do so, to wake up to a fire gone out, and a cold room.

Once storage chamber 23 is filled to the level desired, fill door 33 is closed and fire door 80 is opened. The fire is kindled in usual fashion and once started, fill door 80 is closed. Thus, the system is air tight except for the incoming air through slide valve 78. The system is, of course, open to the atmosphere through the opening 26. Slide valve 78 need be opened only slightly to supply sufficient air to maintain a slow, long burning fire. The more air supplied to fire zone 14, the greater, of course, will be the fire resulting. Quite obviously the amount of air introduced through slide valve 78 should be controlled so as to maintain the fire in the fire zone, to the extent desired.

When loading wood logs into chamber 23 and a fire is going, air valve 78 should be closed prior to opening fill door 33. Thus, on opening the fill door, that opening will become momentarily during loading, the source of air for the burning fire.

Stove 60, as will be seen in reference to FIG. 4 can optionally be provided, if desired, with a viewing glass 120. As these are commonly provided in stoves, any of those materials conventionally used for this purpose will be found satisfactory. The stove desirably will include also in inclined front wall portion 15 a cleanout opening covered by removable air tight cover 122. This will greatly facilitate the cleaning of soot, tars, etc., from the walls of exhaust chamber 24. Cover 122 can obviously be any shape desired and should be of such a size as to enable entry of one's hands, or suitable cleaning implements. The cover can be bolted in position according to usual techniques, or hinged on one side, if desired. The cover will serve as an ideal location for a nameplate or other means of identification.

Figure 8:
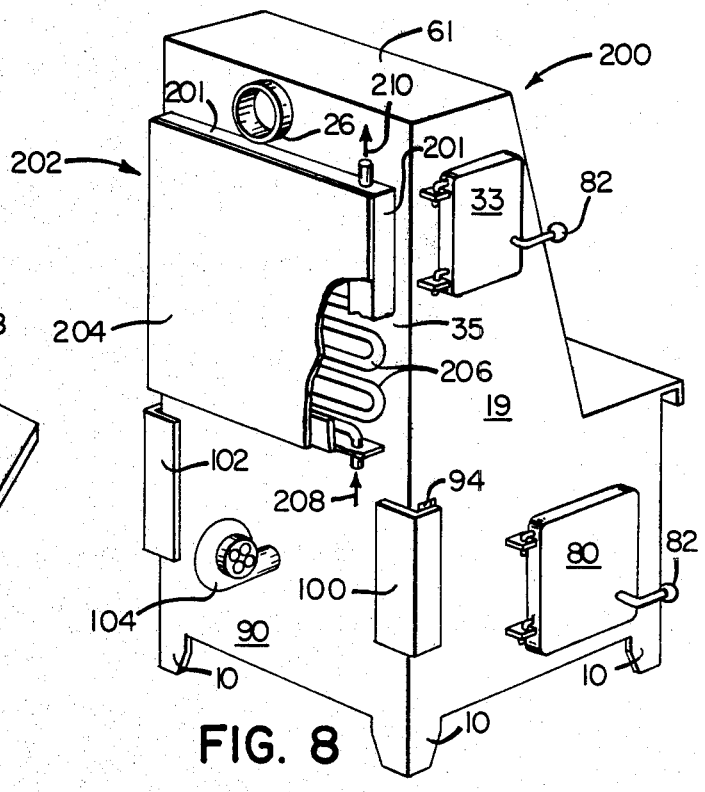
FIG. 8 is a perspective view from the rear illustrating schematically still another embodiment of a stove according to the invention.

Referring now to FIG. 8 of the drawing, there is shown therein still a further embodiment of a stove 200 according to my invention. As shown in that figure, stove 200 is provided on the outer surface of its back wall 35 with a heat deflector assembly 202 which comprises in its basic aspects four U-shaped angle irons 201 arranged in square or rectangular configuration as desired. One leg of each of the angle irons is secured to back wall 35 and the other provides a mounting surface for heat deflector 204 which comprises a suitable size piece of sheet metal. Heat deflector 204 may suitably be provided, if desired, with an outer layer of decorative insulating material. Or insulation can be provided in the cavity formed between heat deflector 204 and back wall 35.

In a further and preferred embodiment of stove 200, water jacket 206 will be provided, as indicated. Thus, cold water will enter at 208, as indicated, and hotter water will exit at 210. Thus, the water jacket will function as a heat exchanger, providing not only hot water but a cooler outer surface for the stove. As a result of this aspect of my invention, it will be appreciated that an even more efficient stove can be provided, making better utilization of the heat provided from the burning fuel.

Obviously, many modifications and variations of the present invention are possible in light of the above teachings. For example, fuels other than wood such as large chunks of coal can also be used as a fuel in the stove 11. However, wood is the preferred fuel. It is to be understood, therefore, that the specific embodiments of the invention as presented in this patent application are intended by way of illustration only and are not limiting on the invention, but that the limitations thereon should be determined only from the appended claims.

What I claim is:

1. A wood burning stove comprising a housing defined by a horizontally disposed top housing surface and bottom, a vertically disposed back wall, a front wall comprising a planar upper wall portion, and a planar vertically disposed lower wall portion, and side walls that extend between and connect together the front wall and back wall, top housing surface and bottom, and which in turn define a lower zone for accommodating a wood burning fire comprising a plurality of logs of predetermined maximum length arranged in parallel relationship to one another and an upper zone which terminates at the top of said lower zone;

a planar horizontally disposed front wall portion which connects said planar upper wall portion to said planar lower front wall portion suitable for accommodation of cooking utensils and which determines the said top of the said lower fire accommodating zone;

a divider located in said housing extending between and connected to the side wall portions and dividing said upper zone into a log storage chamber adjacent said back wall and an exhaust chamber adjacent said front upper wall portion for discharge of the gaseous combustion products from said lower zone, both said log storage and exhaust chamber having bottom openings and each communicating directly with said lower fire accommodating zone, the said divider extending downwards only to the top of said lower zone, and terminating at a horizontal plane approximate to that of the plane defined by said horizontally disposed front wall portion;

an air tight fill door covering an opening in a side wall in said housing and providing access to the top portion of said log storage chamber for the loading of logs, the said log storage zone being sealed and air tight when said air tight fill door is closed and having no other communication to the atmosphere other than the said bottom opening thereof communicating with the lower zone whereby the exhaust gases during start-up and operation of the stove will move to and exhaust only through the said exhaust chamber;

an air tight fire door covering another opening located adjacent said vertical front wall portion in a side wall in said housing and providing access to said lower fire accommodating zone;

a flue discharge opening located in said housing and communicating with the top portion of said exhaust chamber; and means provided in said housing in said lower zone for introduction of air into said lower zone.

2. A wood burning stove according to claim 1 wherein said side walls each comprises an upper inclined portion and a lower vertically disposed portion, and said inclined upper side wall portions incline towards one another from bottom to top, providing a housing of continuously increasing width from top to bottom in said upper zone whereby logs will be supplied in uninterupted fashion to the lower zone without jamming against the side walls of the storage chamber.

3. A wood burning stove according to claim 1 wherein said stove further includes a skirt means juxtaposed to and with said back and bottom walls providing a closed heat transfer chamber for heating of air forced through the chamber, and outlets from said chamber for the discharge of heated air.

4. A wood burning stove according to claim 3 wherein said skirt means further defines an intake port, and means included therein for forcing air through said intake port into said heat transfer chamber.

5. A wood burning stove according to claim 4 wherein discharge outlets are located in the side wall portions of said heat transfer chamber, and said skirt means in association with the bottom wall is open at the front vertical wall of the stove providing a discharge outlet for heated air extending the width of the stove.

6. A wood burning stove according to claim 5 wherein deflector means are provided in association with the heated air outlets on the side walls to deflect heated air toward the front of said housing.

7. A wood burning stove according to claim 6 wherein means are provided allowing communication between said heat transfer chamber and the top of the exhaust chamber for allowing forced air from said heat transfer chamber into the flue opening thereby improving the draft of the stove.

8. A wood burning stove according to claim 7 wherein said communicating means is an adjustable valve means.

9. A wood burning stove according to claim 8 wherein means are included adjacent to said valve means for directing air flow from said heat transfer chamber into a flue communicating with said exhaust chamber.

10. A wood burning stove according to claim 1 further comprising on its back wall heat deflector means.

11. A wood burning stove according to claim 10 wherein said heat deflector means comprises a framework for attachment of a heat deflector plate.

12. A wood burning stove according to claim 11 wherein said heat deflector plate comprises sheet metal.

13. A wood burning stove according to claim 12 wherein said heat deflector means comprises a water jacket and cool water is introduced into said jacket at one end and hotter water removed at the other.

14. A wood burning stove according to claim 1 wherein the said divider comprises a horizontally disposed planar surface parallel to said top horizontally disposed planar surface and connected to the back wall at one end and forming the top of the log storage chamber and a downwardly extending surface at the other end dividing the log storage chamber from the exhaust chamber, and the flue discharge opening is located in the back wall of the housing so as to communicate directly with the exhaust chamber.

15. A wood burning stove according to claim 14 wherein said planar upper front wall portion and said downwardly extending divider surface incline rearwardly toward said back wall providing a log storage chamber that increases gradually in depth from said back wall whereby logs can be readily fed to the fire accommodating lower zone without becoming jammed against the walls of the log storage chamber.

16. A wood burning stove according to claim 15 wherein said downwardly extending divider surface and inclined front wall portion are in parallel planes.

17. A wood burning stove according to claim 16 wherein the cross-sectional area of said exhaust chamber is at least as great as that of the flue discharge opening whereby exhaust gases will be fully discharged from the fire zone.

18. A wood burning stove according to claim 15 wherein said inclined surfaces incline at an angle of from 105–120 degrees from the horizontal.

19. A wood burning stove according to claim 1 wherein said means provided in said housing for introduction of air comprises an adjustable air intake vent in the fire door.

20. A wood burning stove according to claim 1 wherein said means provided in said housing for introduction of air comprises a slide valve located in the vertically disposed front lower wall portion.

21. A wood burning stove according to claim 20 wherein an air manifold extending across the front of the stove between its sides is associated with the said slide valve in the stove housing, said manifold having at least one discharge port for providing air below and across the entire length of burning logs.

22. A wood burning stove according to claim 21, wherein the said air manifold comprises a planar top surface which is connected at one end to the inside of the vertically disposed planar front wall portion and which inclines downwardly away from said wall portion, and a vertically disposed planar surface extending downwardly from the other end, and the bottom of the stove housing comprises a vertically disposed planar surface spaced apart from and parallel to said first-named vertically disposed planar surface and a horizontally disposed planar surface connecting the two vertical surfaces together whereby a rectangular shaped well is provided nearer to said front wall than to said back wall, and a grating is provided in said well spaced apart a suitable distance from said horizontally disposed bottom surface for supporting the burning logs, at least one elongated opening being provided in said vertically disposed surface of the manifold for the introduction of air into the lower zone below the said grating and the supplying of air to substantially the entire width of the burning log fire.

23. A wood burning stove according to claim 22 wherein a removable ash pan is located below said grating for the collection of ashes as the burning logs are consumed.

24. A wood burning stove according to claim 22 wherein said bottom surface further comprises a planar surface which inclines downwardly from and connects the vertically disposed back wall to said vertically disposed surface of the bottom surface whereby logs from the storage chamber are caused to move forwardly in the lower fire accommodating zone as logs first moved forward are consumed by the fire.

25. A wood buring stove according to claim 24 wherin said inclined planar bottom surface inclines at an angle of from 110–135 degrees from the horizontal.

26. A wood burning stove according to claim 25 wherein an opening is provided in said vertically disposed front wall portion and a viewing glass is provided in said opening whereby the burning log fire can be viewed.

27. A wood burning stove according to claim 26 wherein an opening is provided in the upper front wall portion and a detachable cover is provided for said opening whereby cleaning of the exhaust chamber walls is facilitated.

28. A wood burning stove according to claim 1 wherein said bottom comprises a planar inclined surface and a horizontally disposed surface, the inclined surface inclining from said vertically disposed back wall toward said front wall and connecting the back wall to the horizontally disposed bottom surface, the inclined planar bottom surface acting to support logs feeding downwardly from the log storage chamber and to cause them to be moved forwardly in the lower fire accommodating zone, as the logs in front are consumed.

29. A wood burning stove according to claim 1 wherein a skirt is provided in combination with said bottom providing a heat exchange chamber defined by a vertically disposed back wall connected to the back of said housing, a horizontally disposed bottom surface spaced apart from and parallel to the horizontally disposed housing bottom and vertically disposed sides connected to the housing sides, an opening in the back wall of the skirt for the introduction of room temperature air, and openings in each side of the heat exchange chamber for the discharge of heated air, said heat exchange chamber being open at the front thereof for discharge of heated air.

30. A wood burning stove comprising a housing defined by a front wall, a back wall, and side walls that extend between the front wall and back wall, and which in turn define an upper zone, and a lower zone:

a divider located in said housing extending between the side wall portions and dividing said upper zone into an exhaust chamber and a log storage chamber, both said chambers having bottom openings and communicating with said lower zone, the said lower zone being capable of accommodating a wood burning fire comprising a plurality of logs of predetermined maximum length arranged in parallel relationship to one another;

an air tight fill door covering an opening in a side wall in said housing and providing access to the top portion of said log storage chamber;

an air tight fire door covering another opening in a side wall in said housing and providing access to said lower zone;

a flue discharge opening defined by said housing and communicating with the top portion of said exhaust chamber;

an air vent in said housing in said lower zone for introduction of air into said lower zone; and guide means located adjacent to said opening covered by said fill door providing horizontal support to a log being inserted through the fill door into the storage chamber and facilitating their feed into the storage chamber in a parallel relationship.

31. A wood burning stove according to claim 30 wherein said guide means comprises a horizontally disposed rectangualshaped guide bar attached to and extending inwardly from one of said side walls.

32. A wood burning stove according to claim 30 wherein said guide means is a 90° angle iron, one leg which at least is wide enough to support the largest diameter log to be burned in the stove, the other leg of said angle iron being attached in horizontal fashion to the back wall of the stove.

* * * * *